United States Patent [19]

Clay, Jr. et al.

[11] 3,977,123

[45] Aug. 31, 1976

[54] UPWARDLY-ACTING DOOR STRUCTURE

[75] Inventors: Roy T. Clay, Jr., Snyder; Lauren C. Whiting, Clarence, both of N.Y.

[73] Assignee: Whiting Roll-Up Door Mfg. Corporation, Akron, N.Y.

[22] Filed: June 25, 1975

[21] Appl. No.: 590,384

[52] U.S. Cl. ..... 49/102; 105/368 R; 105/410; 160/193; 160/194; 49/125

[51] Int. Cl.[2] ..... E05F 17/00

[58] Field of Search ..... 49/102, 125; 160/193, 160/194; 105/410, 368 R

[56] References Cited

UNITED STATES PATENTS

| | | | |
|---|---|---|---|
| 1,439,373 | 12/1922 | Norwood et al. | 49/102 |
| 2,154,421 | 4/1939 | Cunningham | 49/125 X |
| 3,067,813 | 12/1962 | Henatsch | 160/193 X |
| 3,616,575 | 11/1971 | Harris | 160/193 X |
| 3,911,831 | 10/1975 | Blunden | 105/368 R X |

*Primary Examiner*—Kenneth Downey
*Attorney, Agent, or Firm*—Sommer & Sommer

[57] ABSTRACT

An upwardly-acting door structure is adapted to close an access opening of a body member, such as an automobile-carrying railroad car. The door structure includes a stationary track on either side of the opening, movable tracks mounted for upward and downward movement along the stationary tracks, an upper panel mounted on the movable tracks, a lower panel mounted to move upwardly and downwardly along the movable tracks at twice the speed, flexible chains arranged to interconnect the lower panel with the movable tracks, torsional springs arranged to counterbalance and support the aggregate weight of the raised movable tracks, and handles operatively arranged to raise and lower the movable tracks. The upper and lower panels may be raised to uncover the access opening, or lowered to cover the access opening.

11 Claims, 11 Drawing Figures

Fig. 4.
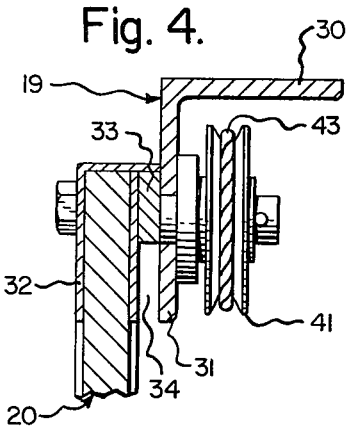
Fig. 5.
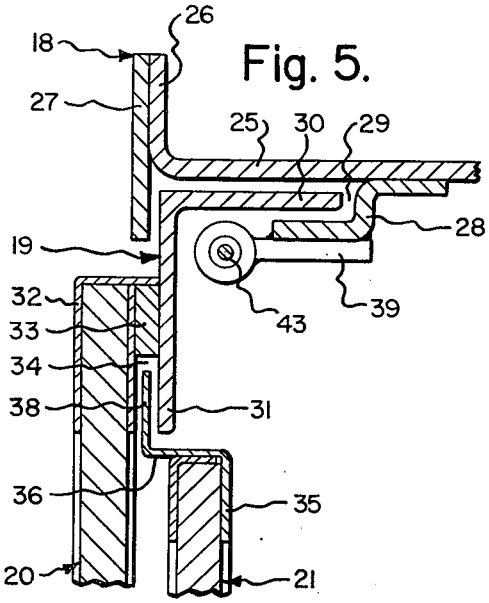
Fig. 6.
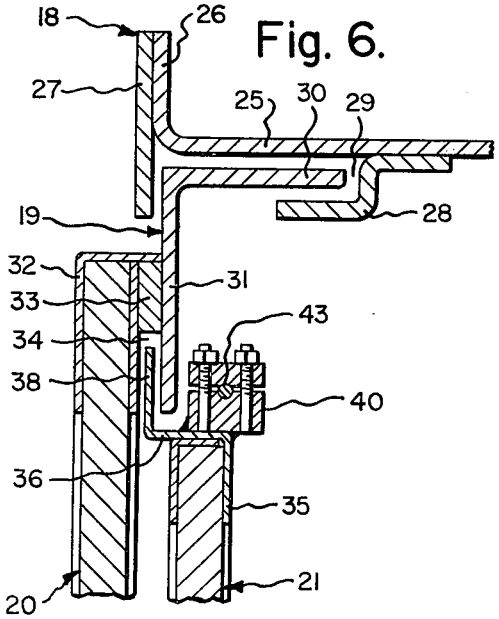
Fig. 7.
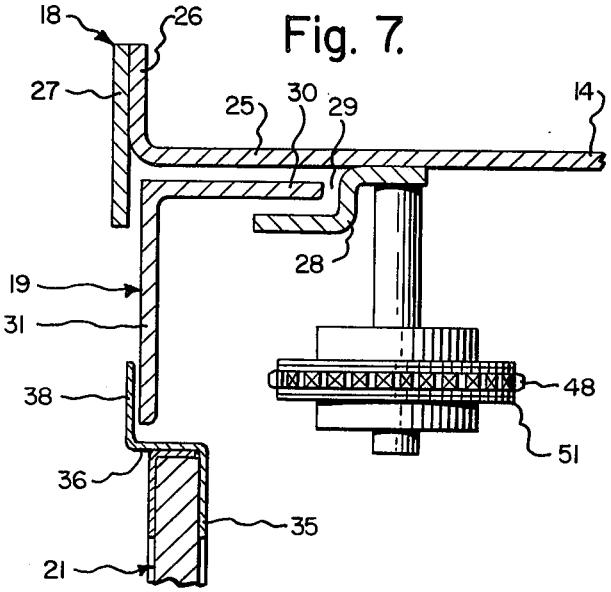
Fig. 8.
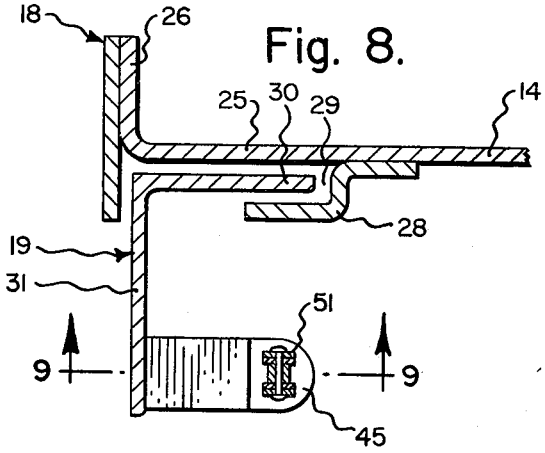
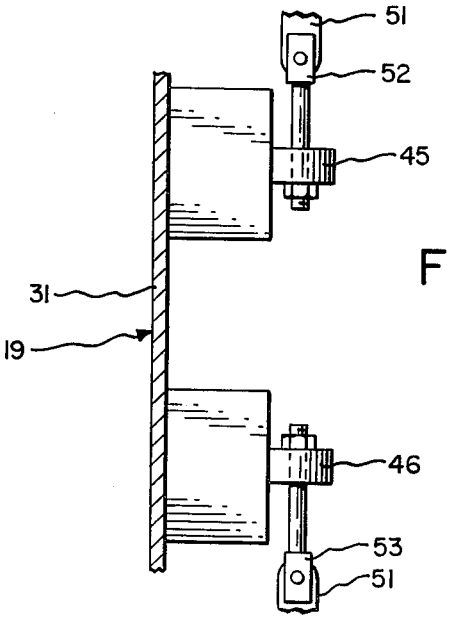
Fig. 9.

UPWARDLY-ACTING DOOR STRUCTURE

BACKGROUND OF THE INVENTION

1. Field of the Invention

The present invention relates generally to upwardly-acting door structures which are adapted to selectively cover or uncover an access opening provided through a body member.

2. Description of the Prior Art

Theft, damage and pilferage during transport are problems which have plagued the automobile and transportation industries. These problems are believed to be particularly acute when automobile-carrying railroad cars are left unattended on unsupervised sidings for considerable lengths of time.

One proposed solution to this problem is to completely enclose the railroad car so as to deny access to thiefs and vandals. However, access and communication between adjacent cars must be provided, when needed, so that automobiles may be driven through adjoining railroad cars during an on-loading or off-loading operation.

Inasmuch as these railroad cars commonly have three levels or tiers on which automobiles or other cargo may be stored, it is believed desirable to expose all such tiers or levels simultaneously during a loading operation.

One proposed door in the prior art included three panels, all of which could be adjustably positioned at one of the levels to expose the two other levels. However, after one level had been loaded or unloaded, each of the doors had to be readjusted to expose another level. Hence, the three levels were not simultaneously exposed.

The problem of designing an adequate door for this environment has been further complicated by the fact that a laterally-movable door might possibly interfere with passing trains.

SUMMARY OF THE INVENTION

The present invention provides an improved upwardly-acting door structure which is adapted to selectively close an access opening provided through a body member, such as a railroad car.

The inventive door structure broadly includes stationary track means mounted on the body member on either side of the opening; movable track means movably mounted on the stationary track means for upward and downward movement therealong between a lowered position and a raised position; an upper panel mounted on the movable track means for movement therewith, and adapted to close an upper portion of the opening when the movable track means is in its lowered position and adapted to uncover the opening when the movable track means is in its raised position; a lower panel mounted to move upwardly and downwardly with and along the movable track means, and adapted to close a lower portion of the opening when the movable track means is in its lowered position, and adapted to uncover the opening when the movable track means is in its raised position; interconnecting means operatively engaging the lower panel and the movable track means for causing the lower panel to move with the movable track means at a speed greater than, and preferably twice, that of the movable track means; energy means operatively arranged to support the aggregate weight of the movable track means; and actuation means selectively operable to cause the movable track means to move upwardly and downwardly.

The actuation means may be selectively operated to move the movable track means between its lowered position at which the upper and lower panels may close the access opening, and its raised position at which these panels may fully uncover this opening.

Accordingly, one general object of the present invention is to provide an improved upwardly-acting door structure which is adapted to selectively close an access opening provided through a body member.

Another object is to provide an improved upwardly-acting door structure which may be moved to fully uncover or expose an access opening.

Another object is to provide an improved upwardly-acting door structure in which the aggregate weight of a raised door is counterbalanced.

In the environment of an automobile-carrying railroad car, another object is to provide an improved upwardly-acting door structure which may be opened to simultaneously expose all levels of tiers within the car.

Still another object in this environment is to provide an improved upwardly-acting door structure which may be locked in its closed position to prevent pilferage, theft or damage from automobiles or other cargo being transported in this railroad car.

These and other objects and advantages will become apparent from the foregoing and ongoing written specification, the drawings, and the appended claims.

BRIEF DESCRIPTION OF THE DRAWINGS

FIG. 4 is a further enlarged fragmentary transverse horizontal sectional view thereof, taken generally on line 4—4 of FIG. 3, and showing the left movable track means and the upper idler pulley mounted thereon.

FIG. 5 is a further enlarged fragmentary longitudinal horizontal sectional view thereof, taken generally on line 5—5 of FIG. 3, and showing the right movable track mounted for sliding movement along the right stationary track, the cable anchor, and further illustrating the lower panel mounted for movement along the movable track.

FIG. 6 is a further enlarged fragmentary transverse horizontal sectional view thereof, taken generally on line 6—6 of FIG. 3, this view being generally similar to FIG. 5 but showing the vise-like cable anchor secured to the lower panel.

FIG. 7 is a further enlarged fragmentary longitudinal horizontal sectional view thereof, taken generally on line 7—7 of FIG. 3, this view showing the idler sprocket mounted on the upper portion of the stationary track.

FIG. 8 is a further enlarged fragmentary transverse horizontal sectional view thereof, taken generally on line 8—8 of FIG. 3, showing the upper chain anchor secured to the movable track means.

FIG. 9 is a fragmentary longitudinal vertical sectional view thereof, taken generally on line 9—9 of FIG. 8, and showing the chain anchors in side elevation.

DESCRIPTION OF THE PREFERRED EMBODIMENTS

Figure 1:
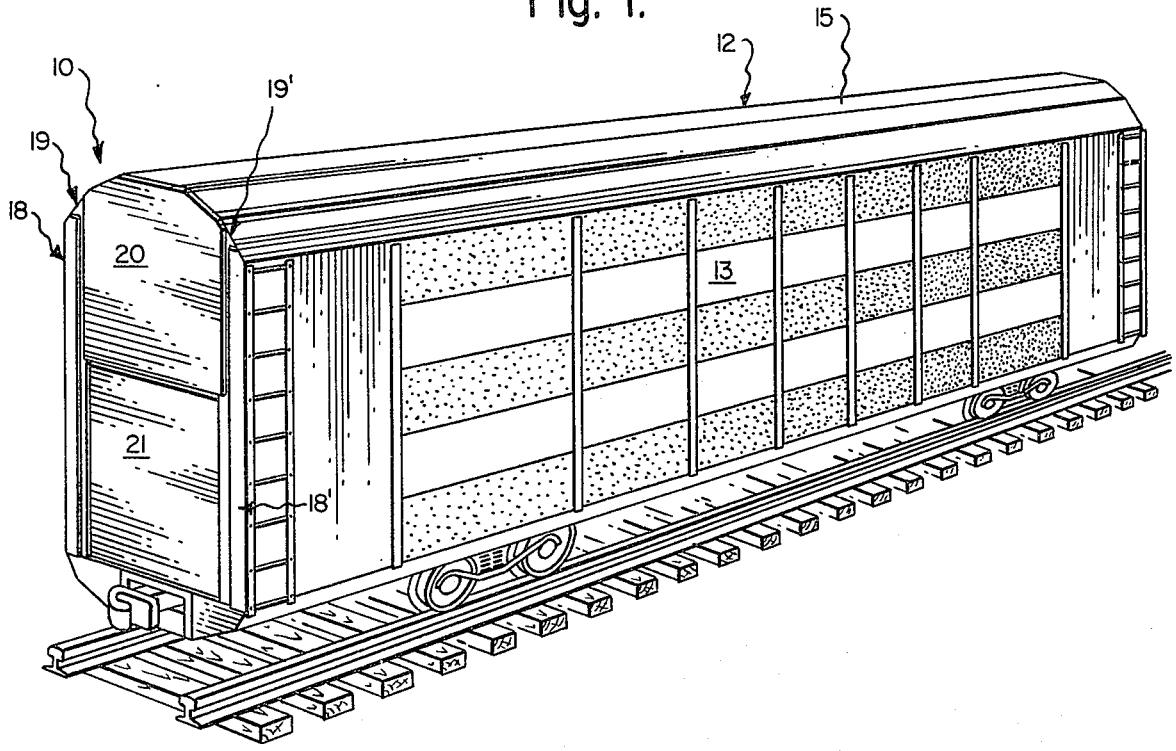
FIG. 1 is a perspective exterior view of an enclosed automobile-carrying railroad car incorporating the inventive upwardly-acting door structure at either end, this view depicting the door structures in their lowered positions to close the car ends.

At the outset, it should be clearly understood that like reference numerals are intended to identify the same elements and/or structure consistently throughout the several drawing figures, as such elements and/or structure may be further described or explained by the entire written specification of which this detailed description is an integral part.

Figure 2:
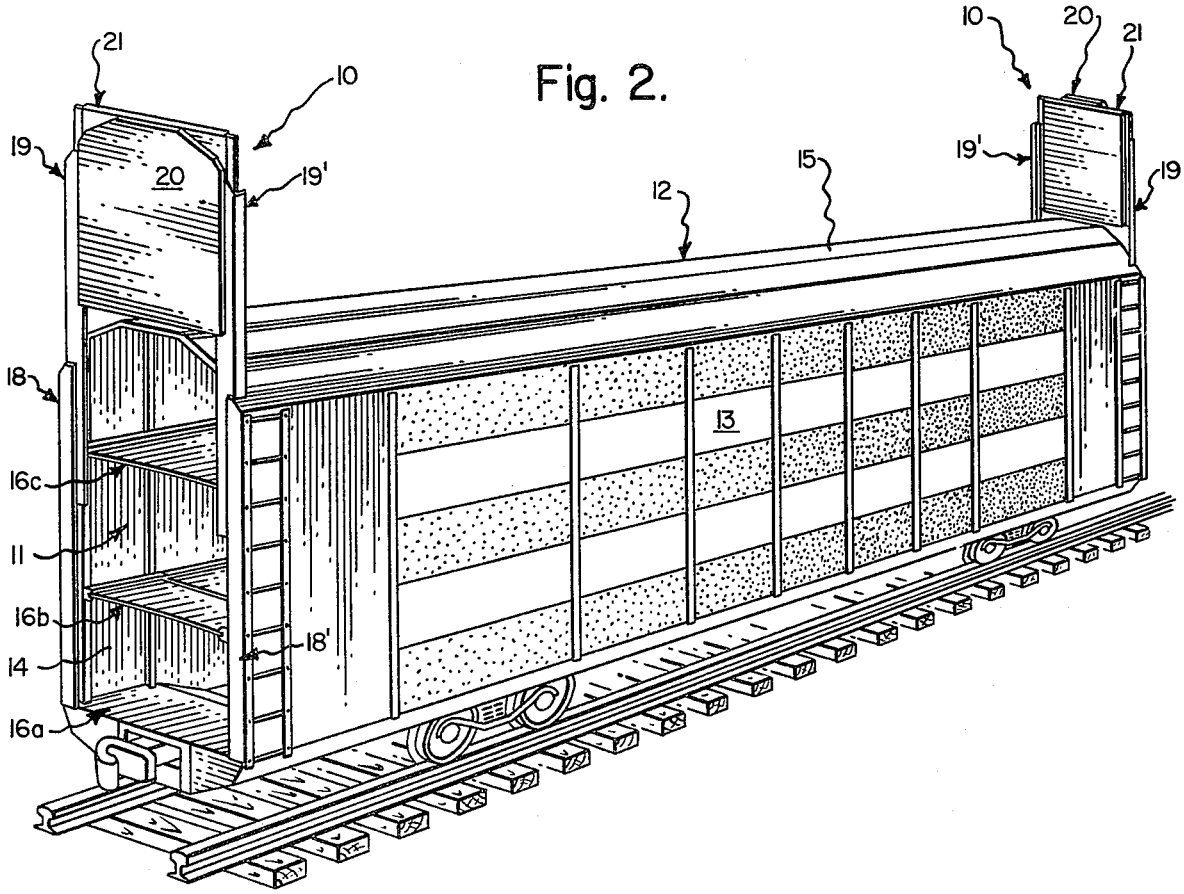
FIG. 2 is a perspective exterior view of the railroad car shown in FIG. 1, but showing the door structures in their raised overhead positions to uncover and expose the car ends.

Referring initially to FIGS. 1 and 2, the present invention provides an improved upwardly-acting door structure, generally indicated at 10, which is adapted to selectively close an access opening 11 (FIG. 2) provided through a body member, generally indicated at 12. In the presently preferred embodiment herein illustrated and described, this body member 12 is specifically shown as being an enclosed automobile-carrying railroad car having an access opening 11 at either end (FIG. 2), a left side vertical wall structure 13, a right side vertical wall structure 14, and a polygonal top structure 15. As best shown in FIG. 2, this railroad car 11 is provided with three vertically-spaced longitudinally-extending substantially horizontal tiers or decks, indicated at 16A-16C in ascending order, upon which an automobile or other suitable vehicle may be driven to on-load or off-load the railroad car, or parked and suitably secured during transportation or shipment.

In the well known manner, about five of these railroad cars 12 may be coupled together and moved to a siding for the purpose of on-loading or off-loading vehicles. Thereafter, suitable ramps may be provided between the corresponding decks or levels 16A-16C of adjacent railroad cars, and the vehicles to be transported may be simply driven through the connected cars during the on-loading or off-loading operation. It should be understood, however, that the present invention herein illustrated and described is not limited by the number of railroad cars which may be so coupled together, or by the nature or type of the vehicle which is to be transported.

Indeed, while the presently preferred embodiment is particularly adapted for use in the railroad industry, the present invention may well find other applications where it is desired to selectively close an access opening provided through a body member. Examples of such other body members may include, but are not limited to, trucks and cargo-carrying vans, buildings, and other structures.

Having set forth our intention to claim the present invention in broad generic terms, the presently preferred embodiment finds particular application in selectively closing the end access opening 11 provided through an enclosed automobile-carrying railroad car 12. In recent years, the problem of theft and pilferage from automobiles being transported by rail has plagued this industry. Indeed, such theft and pilferage has significantly added to the cost of new automobiles, either through increased repair and/or insurance costs, and these added costs are effectively passed on to the consumer who is thus forced to bear the risk of loss.

One possible solution to this problem has been to completely enclose the automobiles during transport and, to this end, an enclosed automobile-carrying universal railroad car body of the general shape depicted in FIGS. 1 and 2 has been developed. However, while one might readily envision several types of doors which could suitably close the open ends of the railroad car, such a door structure should be capable of exposing simultaneously all three levels or decks 16A-16C so as to facilitate on-loading or off-loading operations, and not extend outwardly of the car in a lateral direction so as to possibly interfere with a passing train on a closely adjacent track.

Figure 3:
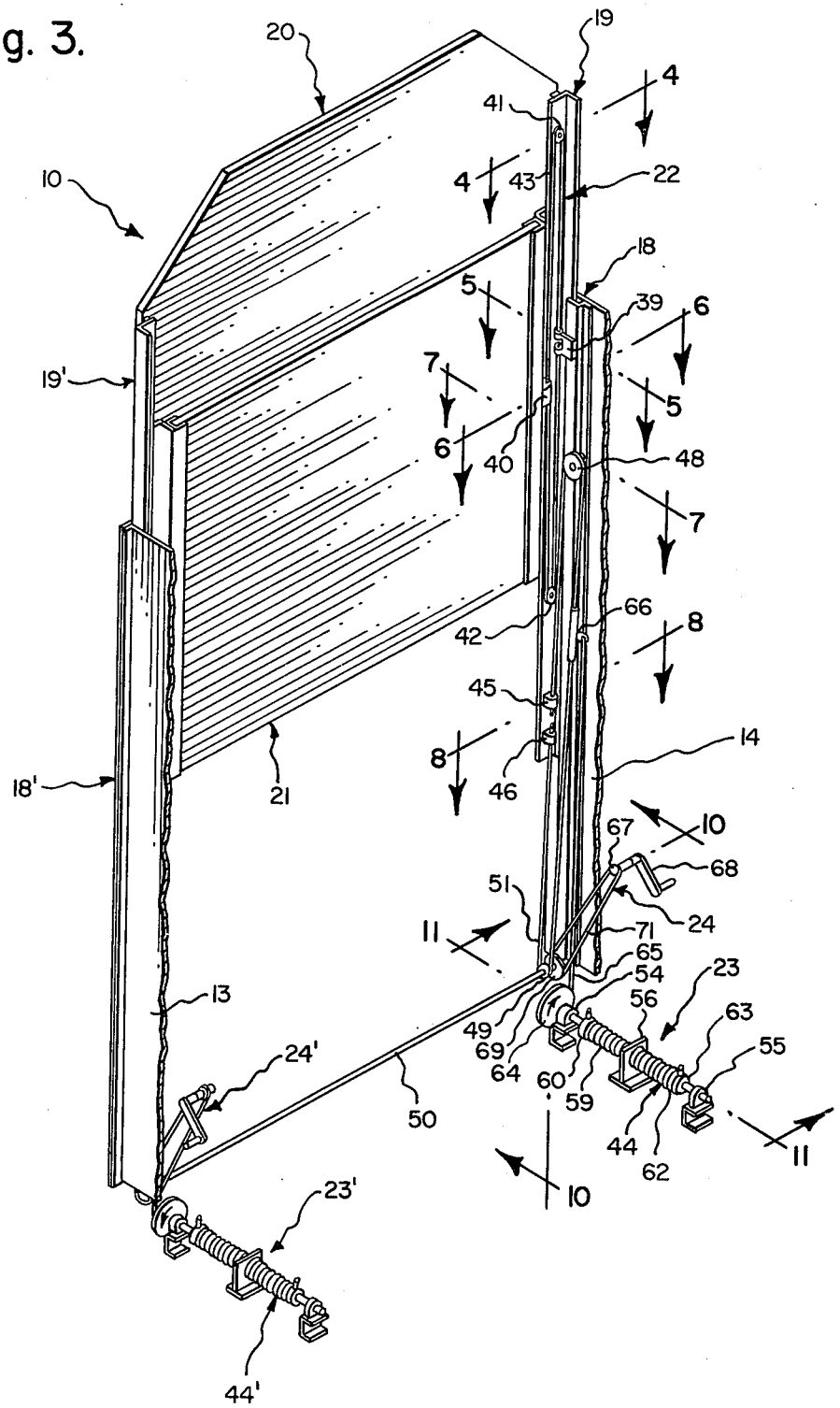
FIG. 3 is an enlarged fragmentary interior perspective schematic view of the inventive door structure partially raised and at an intermediate position, this view showing the stationary and movable tracks, the upper and lower panels, the torsional springs, and the cables and chains interconnecting the various parts thereof.

Referring now to FIGS. 1, 2 and 3, the inventive upwardly-acting door structure 10 broadly includes vertical stationary track means, generally indicated at 18, 18' operatively mounted on the car member 12 along the vertical sides of end access opening 11; movable track means, generally indicated at 19, 19', movably mounted on the stationary track means 18, 18' for upward and downward movement therealong between a lowered position (FIG. 1) and a raised position (FIG. 2); an upper panel 20 mounted on the movable track means for movement therewith and adapted to close an upper portion of end opening 11 when the movable track means is in the aforesaid lowered position (FIG. 1), and also adapted to uncover and expose this access opening 11 when the movable means is in the aforesaid raised position (FIG. 2); a lower panel 21 mounted to move upwardly and downwardly along the movable track means and adapted to close a lower portion of access opening 11 when the movable track means is in the lowered position (FIG. 1), and also adapted to uncover and expose this opening when the movable track means is in the raised position (FIG. 2); interconnecting means, generally indicated at 22, 22' operatively engaging the lower panel 21 and the movable track means 19, 19' for causing he lower panel to move upwardly or downwardly with the movable track means at a speed greater than that of the movable track means; energy means, generally indicated at 23, 23' operatively arranged to support the aggregate weight of the movable track means; and actuation means, generally indicated at 24, 24' selectively operable to cause the movable track means to move upwardly and downwardly. Accordingly, the actuation means 24, 24' may be selectively operated to move the movable track means 19, 19' between the lowered position (FIG. 1) at which the upper and lower panels 20, 21 may close or cover end access opening 11, and the raised position (FIG. 2) at which the upper and lower panels 20, 21 may expose or uncover the end access opening 11.

Referring now to FIGS. 2, 3 and 6, the right and left stationary track means 18, 18' are each shown as being vertically-elongated members extending upwardly along the right and left sides, respectively, of opening 11 from the lowermost deck 16A to intersect with the uppermost inclined segments of polygonal roof 15. As best shown in FIG. 6, the right stationary track means 18 includes in cross-section a longitudinal-elongated portion 25 of car right side vertical wall structure 14; an integral vertically-elongated out-turned flange portion 26; a vertically-elongated transversely-extending plate 27 which extends transversely inwardly beyond right wall portion 25 and is suitably secured, as by welding or suitable fasteners, to out-turned flange portion 26; and a vertically-elongated member 28 having a substantially S-shaped cross-section, one leg surface of which is suitably secured, as by welding or fasteners, to the inside surface of right wall portion 25. Accordingly, right wall portion 25, plate 27 and S-shaped member 28 define therebetween vertically-elongated stationary guide track 29 which is arranged to receive a portion of the movable track means. It will be further appreciated that the left stationary track means 18′ (not explicitly shown) contains elements corresponding to elements 25-29 but arranged as a mirror image of the rightward stationary track means 18.

Referring now principally to FIGS. 3 and 5, the right and left movable track means 19, 19′ are shown as being movably mounted on stationary track means 18, 18′, respectively, for upward and downward movement therealong between a raised position (FIG. 2) and lowered position (FIG. 1). As best shown in FIG. 5, right movable track means 19 includes a vertically-elongated angle member arranged to have its longitudinally-extending leg 30 received in right stationary guide track 29, and have its other transversely-extending leg 31 arranged inwardly of the right side wall structure 14. This right movable track means 19 is shown as further including a vertically-elongated member 32 having an inverted substantially U-shaped cross-section (FIG. 5) and spaced longitudinally from transversely-extending angle leg 31 by an intermediate spacer plate or block 33. Member 32 and spacer block 33 may be suitably secured, as by welding or conventional fasteners, to angle leg 31 to define therebetween a vertically-elongated inwardly-facing rectangular guide track 34 which is arranged to receive and guide vertical movement of the lower panel, as later described. As above mentioned with respect to the stationary track means 18, 18′, it will be further appreciated that the left movable track means 19′ (not explicitly shown) contains elements corresponding to elements 30-34 but arranged as a mirror image of the right movable track means 19.

Adverting now to FIGS. 1–3 and 5, the upper panel 20 is shown mounted on the movable track mans 19, 19′ (FIG. 5) for movement therewith, and is adapted to close an upper portion of access opening 11 when the movable track means is in its lowered position (FIG. 1), and is also adapted to fully expose or uncover access opening 11 when the movable track means is in its raised position (FIG. 2). As best shown in FIG. 1, this upper panel 20 is a vertical plate-like member having its upper edge configured complimentarily with the shape of car roof 15 so that, when the upper panel is in its lowered position (FIG. 1), this polygonal upper panel edge will close access opening 11 but not extend beyond roof 15. As best shown in FIG. 5, the lateral marginal portions of this panel adjacent its vertical right and left edges are suitably received in U-shaped members 32, 32′, and are secured in this position by conventional fasteners. Hence, U-shaped members 32 cover the marginal portions of the upper panel 20, as well as defining guide tracks 34, 34′.

Still referring to FIGS. 1–3 and 5, the lower panel 21 is shown as being mounted to move upwardly and downwardly along the movable track means 19, 19′ and is adapted to close a lower portion of access opening 11 when the movable track means is in its lowered position (FIG. 1), and is adapted to fully expose or uncover access opening 11 when the movable track means is in its raised position (FIG. 2). As best shown in FIGS. 1 and 5, this lower panel 21 is a rectangular vertical plate-like member having marginal portions adjacent its right and left end faces received in vertically-elongated members 35 having inwardly-facing substantially U-shaped cross-sections. These U-shaped members 35 severally include a vertically-elongated L-shaped portion having one longitudinally-extending leg 36 and an integral out-turned transversely-extending leg 38 which is slidably received in right and left movable guide tracks 34, 34′.

In FIGS. 3, 4, 5 and 6, the right interconnecting means 22 is shown as including an anchor plate 39 suitably welded to the inwardly-spaced longitudinal leg of stationary track S-shaped member 28 near an upper portion of stationary track 18 (FIG. 5); a lower panel anchor vise 40 suitably welded to the base of panel U-shaped members 35 (FIG. 6); an upper freely-rotatable idler pulley 41 suitably journalled on an upper portion of movable track leg 31 (FIG. 4); another lower freely-rotatable idler pulley 42 suitably journalled on a lower portion of movable track leg 31 (FIG. 3); and a flexible means, such as cable 43, having one marginal end portion secured to stationary anchor plate 39, an upper portion passed around upper movable track idler pulley 41, an intermediate portion held fast between the jaws of lower panel anchor vise 40, a lower portion passed around lower movable track idler pulley 42, and its other marginal end portion secured to stationary anchor plate 39. This flexible cable 43 is preferably taut so that the lower panel 21 is interlocked to move with the movable track means 19, 19′ in the same direction. It will be appreciated that because of the mechanical advantage afforded by the pulleys 41 and 42, the lower panel 21 will be constrained to move in the same direction as the movable track means, but at twice the speed. In other words, if the movable track means 19 moves upwardly by a distance of one unit, the interlocking means will cause the lower panel 21 to rise upwardly by a distance of two units. Because of the engagement with lower pulley 42, the converse situation also obtains. It will be appreciated that similar anchors, pulleys and cables are provided to interlock the left stationary and movable track means with the left side of lower panel 21.

As best shown collectively in FIGS. 3 and 7–11, the right and left energy means 23, 23′ are operatively arranged to support the aggregate of the movable track means 19, 19′. In the presently preferred embodiment, the right energy means 23 broadly includes lower longitudinally-extending torsional spring means 44 (FIGS. 3 and 11); a pair of upper and lower anchor members 45, 46 suitably secured to a lower portion of right movable track 19 (FIGS. 8 and 9); an upper freely-rotatable toothed idler sprocket 48 suitably journalled on an upper portion of S-shaped member 28 to rotate about a transverse axis (FIG. 7); a lower toothed sprocket 49 mounted fast on a lower transversely-extending timing shaft 50 to rotate therewith; and a flexible chain 51 having one end portion 52 operatively secured to upper anchor block 45, an upper portion passed around upper idler sprocket 48, a lower portion passed around lower sprocket 49, and its other end portion 53 operatively secured to lower anchor block 46. This flexible chain 51 is preferably taut around the aforesaid sprockets such that when shaft 50 rotates, the flexible chain 51 moves to raise or lower the movable track means 19. Of course, it will be readily appreciated that the left energy means 23' is operatively arranged to raise or lower the left movable track means 19', and includes elements and structure corresponding to the elements and structure of the right energy means. It will be further apparent that shaft 50 serves to insure simultaneous movement of the left and right movable track means to prevent their binding with the stationary track means.

Figure 11:
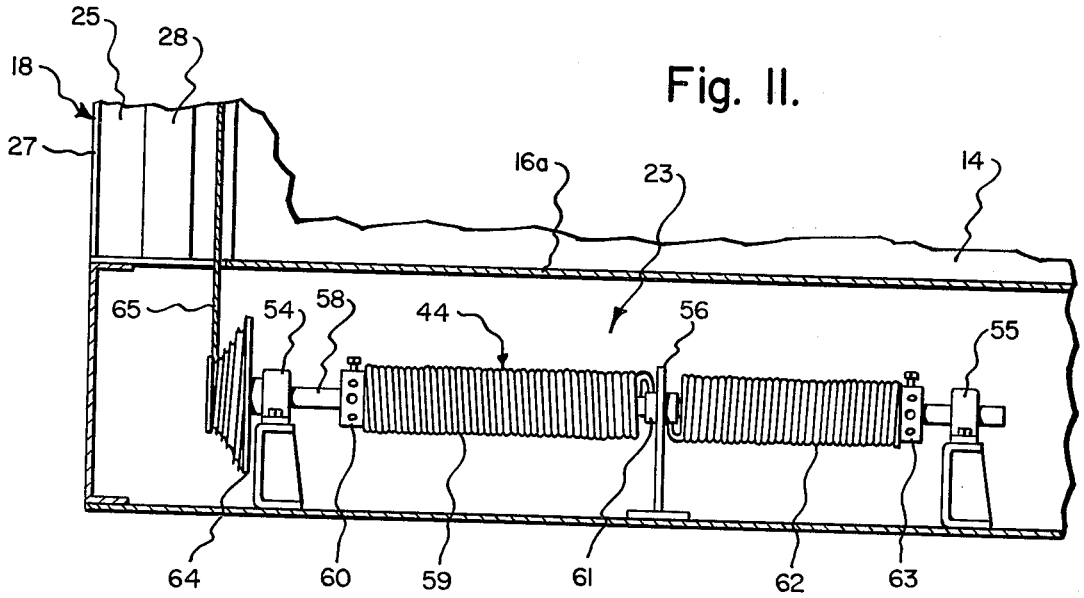
FIG. 11 is a further enlarged fragmentary longitudinal sectional view thereof, taken generally on line 11—11 of FIG. 3, this view showing the right torsional spring means, and the tapered cable drum secured to the spring shaft.

Adverting now principally to FIGS. 3 and 11, the right torsional spring means 44 is shown as broadly including a pair of longitudinally-spaced raised pillow blocks 54, 55 arranged on either side of a stationary intermediate vertical plate 56; a longitudinally-extending rod-like torsional shaft 58 penetrating plate 56 and journalled in pillow blocks 54, 55; a forward torsional spring 59 encircling shaft 58 and secured at its forward end to shaft 58 via a torsional anchor 60 and secured at its rearward end to collar 61 fixed to stationary plate 56; and a rearward torsional spring 62 encircling shaft 58 and secured at its forward end to collar 61 and at its rearward end to shaft 58 via torsional anchor 63.

Moreover, a tapered cable drum 64 is mounted fast on the forward marginal end portion of shaft 58. This cable drum 64 is shown as being a forwardly-convergent frusto-conical member provided with a plurality of helically-wound trough-like adjacent cable convolutions on its tapered surface. It will be apparent that the radius of adjacent cable convolutions will decrease toward the front of the cable drum 64, for a purpose hereinafter explained.

The right torsional spring means 44 further includes a flexible cable 65 having its upper end portion suitably secured to an anchor link 66 of flexible chain 51 (FIG. 3), and having its lower end secured to cable drum 64, with a plurality of cable convolutions arranged in the tapered drum troughs.

Inasmuch as the radius of tapered cable drum 64 is a linear function of the angular position of drum 64, the moment arm between the axis of shaft 58 and the centerline of cable 65, at the point where it leaves drum 64 tangentially, is also a linear function of drum angular position. Moreover, persons skilled in this art will realize that the spring-rate of torsional springs 44, 44' is constant within its operating range. In other words, the amount of torque exerted on shaft 58 by the torsional springs is a linear function of the angular position of shaft 58.

One unique feature of the present invention is to configure drum 64 to have negative slope so that as the drum unwinds, this shown as being counterclockwise in FIG. 3, the radius or moment arm of the drum 64 will increase. At the same time, it is desired to preload the torsional springs by rotating shaft 58 to a preselected angular position before the cable 65 is engaged with drum 64. Thus, as the torsional springs are being further wound, the effective moment arm of the drum will decrease. Conversely, when the torsional springs unwind, the effective moment arm of the drum will increase. In other words, from an initial angular position, the moment arm of the cable drum will decrease as the torsional springs further wind, and will increase as the torsional springs further unwind. Considering the dimensional configuration of drum 64, the torsional springs may be preloaded by rotation in the appropriate angular direction such that the torsional spring means 44 may exert substantially constant pulling force on the flexible chain 51. In other words, if the effective drum radius varies negatively with angular position, while the torsional spring force varies positively with angular position, these two curves, when superimposed, may substantially cancel one another in a manner such that the torsional spring means 44 may exert a substantially constant pulling force on flexible lifting chain 51.

It will be further appreciated that as the doors are raised from the fully lowered position (FIG. 1), the aggregate weight of the movable track means will also include the weight of the upper and lower panels. Hence, the right and left torsional spring means 44, 44' may be designed such that the substantially constant pulling force exerted by the spring means 44, 44' on the flexible chains 51, 51' will nominally equal the aggregate weight of the movable track means 19, 19' in the raised position. Hence, the torsional spring means 44, 44' may effectively counterbalance the aggregate or composite weight of the movable track means so that an operator desiring to raise or lower the door need only supply additional energy to overcome frictional forces between the various moving parts.

In this regard, it will be appreciated and understood that the right and left torsional spring means 44, 44' may be so dimensioned and preloaded to support the weight of the right and left movable tracks 19, 19', respectively.

Figure 10:
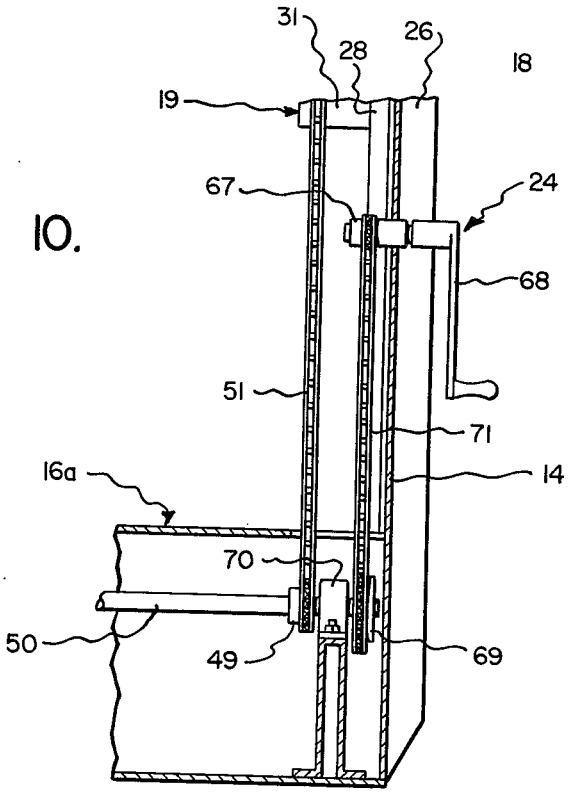
FIG. 10 is a further enlarged fragmentary transverse vertical sectional view thereof, taken generally on line 10—10 of FIG. 3, showing the right actuation chain engaging the upper handle sprocket and the lower shaft sprocket.

As best shown in FIGS. 3 and 10, the right and left actuation means 24, 24' engage transverse shaft 50, and are selectively operable to cause the movable track means 19, 19' to move either upwardly or downwardly. The right actuation means 24 broadly includes an upper sprocket 67 suitably journalled on the right car wall and having an outer exterior handle 68 which may be grasped by an operator and suitably rotated; a lower sprocket 69 mounted fast on a marginal end portion of transverse shaft 50 on the outboard side of pillow block 70 in which the shaft 50 is rotatably journalled; and a taut endless flexible chain 71 operatively engaging sprockets 67 and 69. Thus, any operator may grasp right handle 68 and rotate it in a suitable direction to rotate shaft 50, thereby raising or lowering the movable track means and the door panels. As previously noted, the torsional spring means 44, 44' is uniquely configured to supply sufficient energy to overcome the aggregate weight of the raised movable track means, so that the operator need only supply additional energy to overcome frictional forces between various moving parts. To this end, it is presently desired to provide about a three-to-one reduction ratio between sprockets 69 and 67. In other words, the diameter of lower sprocket 69 is nominally about three times the diameter of upper sprocket 67.

Of course, the left actuation means 24' is similar to right actuation means 24, and allows the door structure to be raised or lowered from either side of the car.

In this manner, the present invention provides a unique upwardly-acting door structure which is adapted to selectively close or expose an access opening provided through a body member. While this door structure is particularly suitable for use on automobile-carrying railroad cars, the inventive door structure possesses far broader utility. Accordingly, the invention defined in the following claims should not be limited to the particular field of use herein illustrated in conjunction with the presently preferred embodiment.

Similarly, persons skilled in this art will readily appreciate that various changes and modifications may be made. For example, in lieu of the torsional spring means, the movable track means may be lifted by hydraulic, pneumatic, or other mechanical means. The particular types and arrangements of the various chains and cables may be readily modified, as may the shape and configuration of the various stationary and movable tracks. The upper and lower panels may also be interconnected in a manner such that the lower panel will rise at other speeds greater than the upper panel. Moreover, a suitable locking mechanism, such as a leaf spring with a projecting pin, may be provided to prevent unintended lowering of the door structure when in the raised position.

Therefore, while the embodiment herein illustrated and described constitutes a presently preferred form of the present invention, it should be clearly understood by persons skilled in this art that other forms, as specified in the claims, achieving like objects and advantages might also be adopted. Having disclosed as the "best mode" a presently preferred species of what we regard as our broader invention, we wish to define our invention generically in the following claims so as to include every form in which our invention may be copied.

What is claimed is:

1. An upwardly-acting door structure adapted to selectively close an access opening provided through a body member, comprising:

stationary track means mounted on said body member along the sides of said opening;

movable track means movably mounted on said stationary track means for upward and downward movement between a lowered position and a raised position;

an upper panel mounted on said movable track means for movement therewith, said upper panel being adapted to close an upper portion of said opening when said movable track means is in said lowered position, and adapted to uncover said opening when said movable track means is in said raised position;

a lower panel mounted to move upwardly and downwardly along said movable track means, said lower panel being adapted to close a lower portion of said opening when said movable track means is in said lowered position, and adapted to uncover said opening when said movable track means is in said raised position;

interconnecting means operatively engaging said lower panel and said movable track means for causing said lower panel to move with said movable track means at a speed greater than that of said movable track means;

energy means operatively arranged to support the weight of said movable track means; and actuation means selectively operable to cause said movable track means to move upwardly and downwardly, whereby said actuation means may be selectively operated to move said movable track means between said lowered position at which said panels may close said opening, and said raised position at which said panels may uncover said opening.

2. The upwardly-acting door structure as set forth in claim 1 wherein said stationary track means includes a stationary guide track in which said movable track means is slidably mounted.

3. The upwardly-acting door structure as set forth in claim 2 wherein said stationary track means includes a portion of said body member.

4. The upwardly-acting door structure as set forth in claim 2 wherein said movable track means includes a movable guide track in which said lower panel is slidably mounted.

5. The upwardly-acting door structure as set forth in claim 4 wherein said movable track means includes an angle member having one leg portion operatively arranged in said stationary guide track for movement therealong, and wherein said upper panel is spaced from the other angle member leg portion to define therebetween said movable guide track.

6. The upwardly-acting door structure as set forth in claim 5 wherein said lower panel is operatively arranged to engage said movable guide track for slidable movement therealong.

7. The upwardly-acting door structure as set forth in claim 1 wherein said interconnecting means comprises an upper freely-rotatable idler pulley suitably journalled on an upper portion of said movable track means, a lower freely-rotatable idler pulley suitably journalled on a lower portion of said movable track means, and flexible means secured to said stationary track means and secured to said lower panel and having an upper portion passed around said upper pulley and a lower portion passed around said lower pulley, whereby said interconnecting means causes said lower panel to move in the same direction as said movable track means at twice its speed.

8. The upwardly-acting door structure as set forth in claim 1 wherein said energy means comprises a freely-rotatable idler sprocket journalled on an upper portion of said stationary track means, flexible chain means having one end portion secured to a lower portion of said movable track means, and an intermediate portion passed around said idler sprocket, and torsional spring means operatively associated with said flexible chain means.

9. The upwardly-acting door structure as set forth in claim 8 wherein said torsional spring means includes a rotatable shaft, a torsional spring arranged to urge said shaft to rotate, and a cable drum mounted fast to said shaft and configured to provide a moment arm which varies with angular position, and wherein said torsional spring is preloaded such that said torsional spring means may exert substantially constant pulling force on said flexible chain means.

10. The upwardly-acting door structure as set forth in claim 9 wherein said actuation means operatively engages said flexible chain means, whereby to move said movable track means an operator need only supply additional energy to said actuation means to overcome frictional forces between moving parts of said door structure.

11. The upwardly-acting door structure as set forth in claim 1 and further comprising:

timing means operatively arranged to insure cooperative movement of said movable track means to prevent binding thereof with said stationary track means.

* * * * *